United States Patent [19]

Greenan

[11] 4,011,667

[45] Mar. 15, 1977

[54] SAFETY SHOES

[75] Inventor: Wirt G. Greenan, Wakefield, Mass.

[73] Assignee: Safety Box Toe Company, Wakefield, Mass.

[22] Filed: June 28, 1976

[21] Appl. No.: 700,101

[52] U.S. Cl. ..... 36/77 R; 36/72 R

[51] Int. Cl.[2] ..... A43C 13/14

[58] Field of Search ..... 36/72 R, 77 R

[56] References Cited

UNITED STATES PATENTS

| | | | |
|---|---|---|---|
| 1,823,924 | 9/1931 | Williams | 36/72 R X |
| 1,826,645 | 10/1931 | Bergquist | 36/72 R X |
| 2,020,037 | 11/1935 | McMurray et al. | 36/72 R X |
| 2,409,880 | 10/1946 | McMurray | 36/77 R |
| 2,988,829 | 6/1961 | Johnsen | 36/72 R |
| 3,165,841 | 1/1965 | Rollman | 36/77 R |
| 3,410,007 | 11/1968 | Peterson | 36/77 R |
| 3,845,576 | 11/1974 | Howland | 36/77 R |

FOREIGN PATENTS OR APPLICATIONS

| | | | |
|---|---|---|---|
| 722,803 | 2/1955 | United Kingdom | 36/72 R |

*Primary Examiner*—Alfred R. Guest
*Attorney, Agent, or Firm*—Kenway & Jenney

[57] ABSTRACT

In a welt shoe having a resilient cushion outsole there is provided a crush-proof safety box toe incorporated in the toe portion of the shoe and associated with a stress-distributing plate anchored above the outsole and beneath the insole in position to distribute stresses exerted by the safety box toe when it receives a blow.

8 Claims, 4 Drawing Figures

FIG. 1
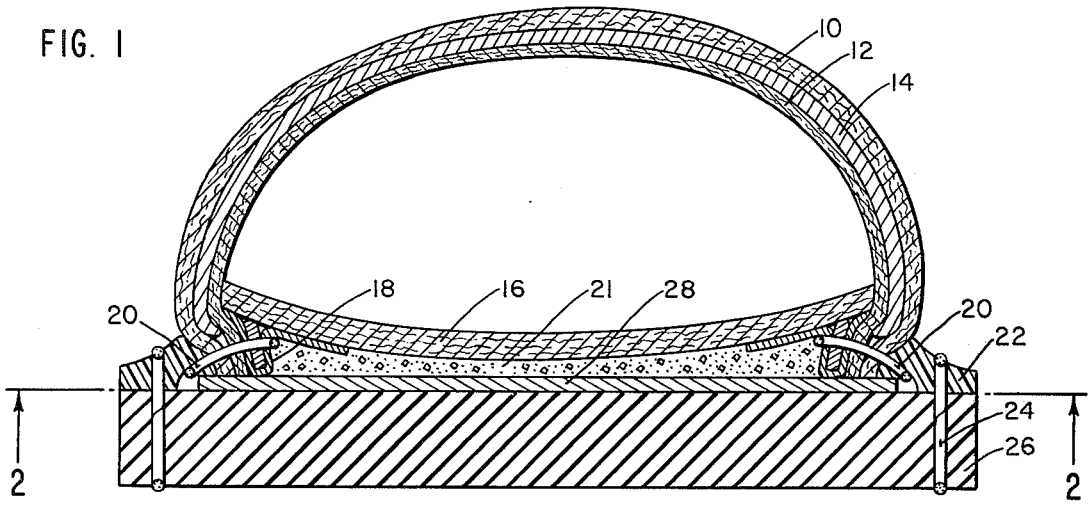
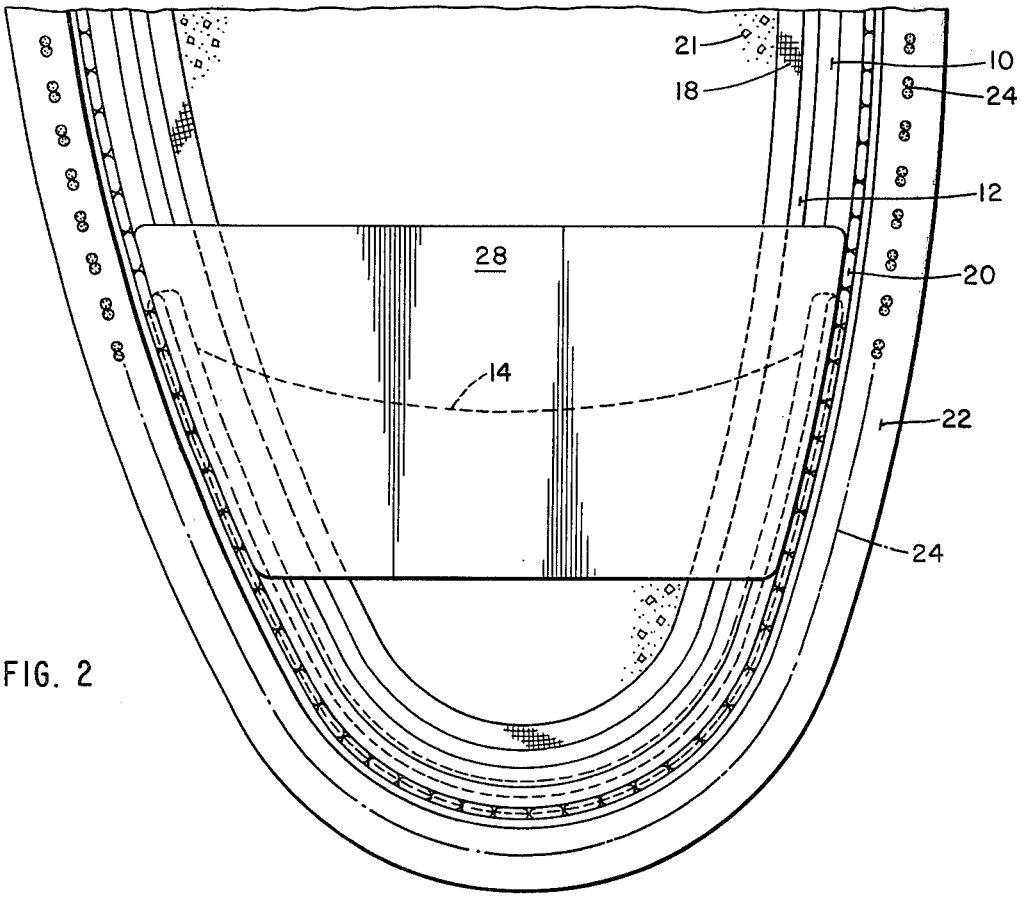
FIG. 2

FIG. 3
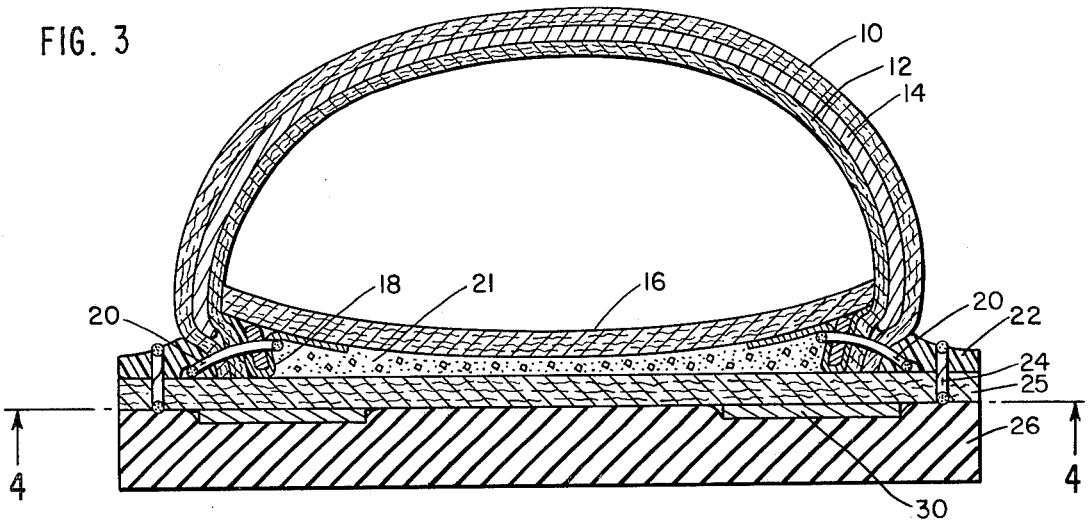
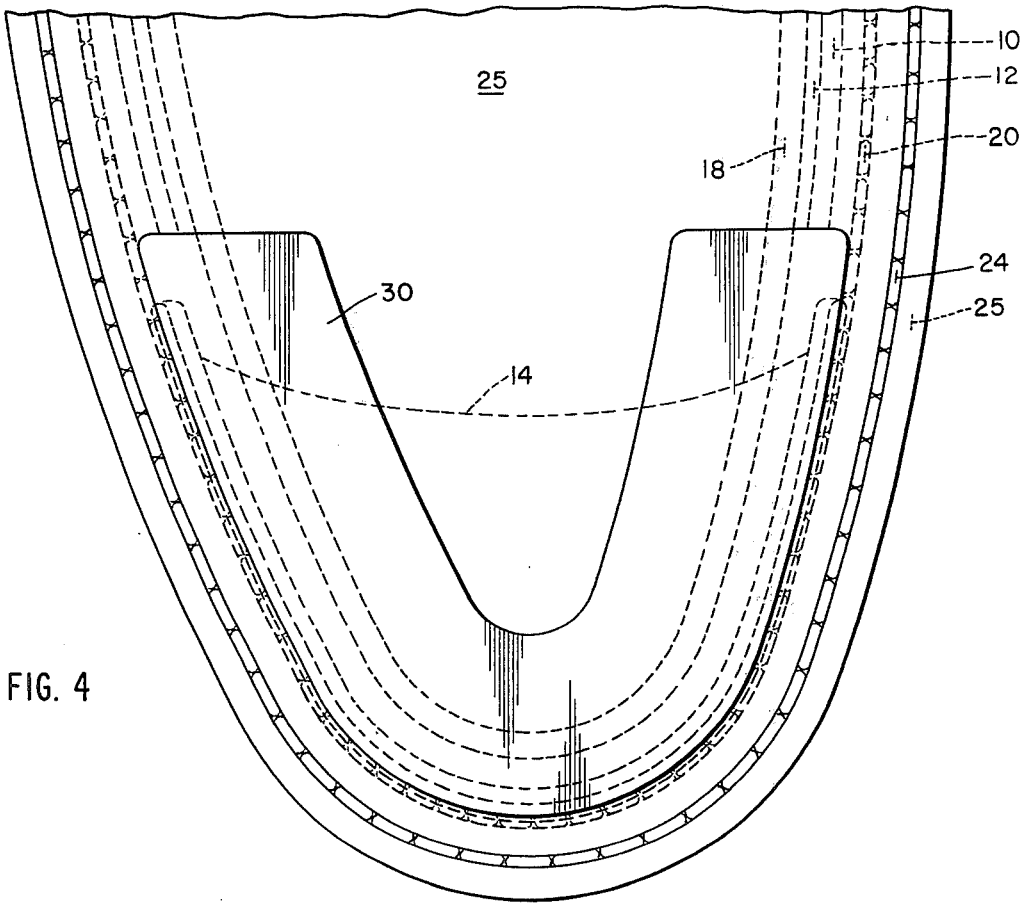
FIG. 4

SAFETY SHOES

BACKGROUND OF THE INVENTION

As evidenced, for example, in U.S. Pat. No. 1,823,924 granted to A. A. Williams on September 22, 1931, it has for many years been customary to provide shoes equipped with steel box toes incorporated between the upper and the lining in the toe portion of the shoe, the purpose being to protect the toes of the wearer from injury which would otherwise occur when heavy objects are accidentally dropped on the toe portion of the shoe. Recently safety box toe shoes have become of marked attention because of the requirements of OSHA. For example, the present requirements for the highest classification of safety toe shoes require that a specimen shoe be subjected to a test in which a weight is dropped on the toe portion of the shoe under conditions such that it exerts an impact of 75 foot pounds on the toe. If the result is to depress the toe so that the clearance inside the toe portion is less than ½ inch, the shoe has not passed the test. Moreover, the toe portion must also be subjected to compression of 2,500 pounds; again, if the toe portion is depressed to provide less than one-half inch clearance, the shoe has not passed the test.

In so-called cement shoes no particular problem is presented, since it is merely a matter of providing safety toes of suitable steel alloy, thickness and dimensions. In such shoes the safety toe can be produced having a relatively broad base flange of sufficient width to distribute the stresses exerted by the steel toe when it encounters a blow. However, an acute problem is presented when it is desired to manufacture welt shoes having cushion outsoles. Of course welt shoes are generally favored because of the ease with which they can be re-soled when necessary. Furthermore, workmen prefer cushion outsoles, such as crepe rubber, since they are more comfortable and less tiring. However, a steel toe having a sufficiently broad base flange cannot be incorporated in ordinary welt construction, since the flange would interfere with the needle as it forms the inseam which joins the overlasted margin of the upper and the welt to the conventional sewing rib formed on the lower surface of the insole.

It is the principal object of this invention to provide a safety box toe system which can be incorporated in a welt shoe having a resilient cushion sole, without interfering with the conventional operations involved in welt shoemaking.

One approach to the problem is suggested in U.S. Pat. No. 2,438,016 to H. G. McMurray issued Mar. 16, 1948. That patent discloses a discontinuous welt which cooperates with a separate toe plug cemented in place, the result being that there is no inseam about the toe portion of the shoe. While that construction is feasible, it adds to the cost of making the shoe, since additional operations are required. I am also aware of U.S. Pat. No. 1,826,645 issued to J. U. Bergquist on Oct. 6, 1931. That patent discloses a construction including a steel box toe and a metal supporting plate, both being incorporated in a vulcanized rubber boot. The plate and the steel toe are in contact with each other, and the construction is one which would not be feasible in a welt shoe construction.

Another approach has been to provide a steel box toe with a flange of relatively narrow width and to subject the toe portion of the insole to a reducing step which, in effect, sinks the flange of the steel toe sufficiently beneath the surface of the insole so that it does not intercept the inseam needle, but shoes so made will not pass the most stringent OSHA test. Moreover, the extra step of producing the insole adds to the cost of manufacture.

SUMMARY OF THE INVENTION

The safety box toe system of my invention incorporates a steel box toe either having no base flange or a base flange of relatively narrow width. The lower edge of the steel box toe is usually merely rounded over to present a blunt surface rather than a sharp edge which would cut into the material beneath it. The shoe is lasted in conventional manner, a steel box toe being interposed between the upper and the lining. Thereafter the overlasted margin of the upper and lining and the welt are sewn to a sewing rib provided on the lower surface of the insole. After the usual trimming operation has been carried out, a bottom filler is disposed in the area within the sewing rib. Then a stress absorbing plate is secured in place in the toe beneath the insole and beneath the lower edge of the steel toe, the periphery of the plate being disposed adjacent the inner edge of the welt. Thereafter an outsole is sewn to the welt, again in conventional manner. As an alternative embodiment of the invention the stress absorbing plate may, if a midsole is used, be secured to the lower surface of the midsole which is sewn to the welt, and an outsole is subsequently cemented to the midsole.

The stress absorbing plate may take the shape of a horseshoe, may be substantially a rectangle spanning an area at the toe portion of the shoe, or may be shaped to cover the entire area of the toe portion lying within and adjacent the inner edge of the welt.

BRIEF DESCRIPTION OF THE DRAWINGS

FIG. 1 is a view in cross-section through the toe portion of a shoe constructed in accordance with the invention, FIG. 2 is a view in cross-section along the line 2—2 of FIG. 1, FIG. 3 is a view in cross-section through the toe portion of a shoe constructed in accordance with another embodiment of the invention, and FIG. 4 is a view in cross-section along the line 4—4 of FIG. 3.

DESCRIPTION OF THE PREFERRED EMBODIMENTS

As shown in FIGS. 1 and 2 a welt shoe is assembled in customary fashion. There is provided an upper 10 and a lining 12 between which is disposed a flangeless steel box toe 14. The composition and dimensions of the steel toe 14 are such as to provide the required resistance to forces exerted on the toe portion of the shoe. By "flangeless" I mean to distinguish from a steel box toe having a relatively wide flange integral with the base. Such flanges are normally in the order of at least 3/16 inch. The steel toe employed in the practice of the invention has a rounded lower edge producing what might perhaps be termed a vestigial flange since it has a span of less than 1/16 inch. Its purpose is merely to provide a relatively blunt lower edge. The upper and lining are lasted as usual to a sewing rib 18 secured to the lower surface of a conventional insole 16. Then the overlasted margins of the upper and lining and a welt 22 are secured to the sewing rib 18 by a line of stitching 20 formed in the conventional inseaming operation. The next step is to trim the overlasted margins of the upper 10 and lining 12, following which the usual filler 21 is disposed in the area inside the sewing rib 18.

In the next operation a steel stress absorbing plate 28 is secured to the bottom of the shoe by cement, tacks, or other securing means. The stress absorbing plate is best shown in FIG. 2 and is substantially in the form of a rhomboid or rectangle. The plate 28 spans a portion of the toe area from a line lying in a plane with the rear edges of the steel box toe to a line somewhat to the rear of the forward end of the shoe. It is to be understood, however, that the plate 28 could be shaped to cover the entire toe portion. It is vitally important that the outer periphery of the plate 28 terminate inside the line where the outseam will be formed. In order to provide sufficient tolerance I prefer to have the outer periphery of the plate 28 adjacent the line of the inseam stitches. The periphery terminates slightly inside the inseam stitches so that the operator has a visible guide to assist him in positioning the plate 28 properly.

After the plate 28 has been secured in place, an outsole 26 is secured to the welt 22 by means of a line of stitching 24, the operation being carried out on the customary outsole rapid lock stitch machine.

In FIGS. 3 and 4 there is shown another embodiment of the invention. As before, an upper 10 and lining 12, with a flangeless steel box toe 14 disposed between them, are lasted to a sewing rib 18 secured to the lower surface of an insole 16. A welt 22 is secured to the sewing rib and the overlasted margins of the upper and lining by means of an inseam 20. A filler 21 is disposed in conventional fashion. Then a midsole 25 is secured to the welt 22 by means of an outseam 24.

The next step is to secure in position on the lower surface of the midsole 25 a horseshoe-shaped stress-absorbing plate 30. The shoe is then finished by cementing an outsole 26 to the bottom of the midsole 25, the stress-absorbing plate 30 thus being secured in proper position.

In both embodiments of the invention the construction is such that when a force is exerted downwardly on the toe portion of the shoe, the stresses engendered by the downward movement of the steel toe 14 are absorbed by the plate 28 or 30. Consequently the outsole 26 may be made of crepe rubber or other relatively soft and resilient cushioning material. It will therefore be evident to those skilled in the art that the system of my invention permits the construction of a safety box toe welt shoe by ordinary conventional operations without significant increase in cost. Moreover, the system of my invention makes it possible to produce a safety shoe which is satisfactory from the safety standpoint and also permits the employment of a comfortable cushion outsole.

I claim:

1. A safety box toe system comprising a welt shoe, a flangeless box toe of crush-resistant material mounted beneath the upper, a stress-absorbing plate disposed beneath the insole, aligned with the lower edge of the box toe and having its periphery lying adjacent the inseam line, and an outsole of resilient material.

2. A safety box toe system for a welt shoe including an upper, an insole secured to the upper by an inseam, and an outsole of resilient cushioning material, said system comprising a box toe of crush resistant material mounted beneath said upper, and a stress absorbing plate disposed above said outsole and having its periphery lying adjacent the line of the inseam, whereby stresses generated by downward movement of the lower edge of said box toe are distributed through said plate.

3. In a welt shoe comprising an upper, an insole, a welt secured to the insole and an outsole secured to the welt, a safety box toe system comprising a metal box toe disposed beneath the upper, and a stress-absorbing plate disposed beneath the insole and having a portion disposed beneath the lower edge of the metal box toe.

4. The safety box toe system of claim 3 wherein the plate lies on the upper surface of the outsole.

5. The safety box toe system of claim 2 wherein a midsole is sewn to the welt, the outsole is secured to the midsole, and the plate is disposed between the outsole and the midsole.

6. The safety box toe system of claim 1 wherein the plate is shaped to cover the entire toe portion of the shoe beneath the box toe.

7. The safety box toe system of claim 1 wherein the plate has substantially the shape of a rectangle and spans part of the toe portion of the shoe beneath the box toe.

8. The safety box toe system of claim 1 wherein the plate is shaped as a horseshoe.

* * * * *